US012029283B2

(12) United States Patent
Clark

(10) Patent No.: US 12,029,283 B2
(45) Date of Patent: Jul. 9, 2024

(54) BELT BUCKLE SYSTEMS AND METHODS

(71) Applicant: XPAND INC., Toronto (CA)

(72) Inventor: Rhys Clark, Toronto (CA)

(73) Assignee: Xpand Inc., Ontario (CA)

( * ) Notice: Subject to any disclaimer, the term of this patent is extended or adjusted under 35 U.S.C. 154(b) by 254 days.

(21) Appl. No.: 17/224,958

(22) Filed: Apr. 7, 2021

(65) Prior Publication Data

US 2022/0322794 A1 Oct. 13, 2022

(51) Int. Cl.

| | |
|---|---|
| ***A44B 11/00*** | (2006.01) |
| ***A41F 9/00*** | (2006.01) |
| ***A44B 11/04*** | (2006.01) |

(52) U.S. Cl.

CPC ..... *A44B 11/04* (2013.01); *A41F 9/002* (2013.01)

(58) Field of Classification Search

CPC ..... A44B 11/258; A44B 11/04

See application file for complete search history.

(56) References Cited

U.S. PATENT DOCUMENTS

| | | | | |
|---|---|---|---|---|
| 2,219,537 A | | 10/1940 | White | |
| 2,615,227 A | | 10/1952 | Frederick | |
| 2,956,324 A | | 10/1960 | Ann | |
| 3,376,616 A | | 4/1968 | John | |
| 4,651,989 A | | 3/1987 | Wilson | |
| 5,323,516 A | * | 6/1994 | Hartmann | A44C 5/2071 24/303 |
| 5,709,621 A | | 1/1998 | Wilson | |
| 6,173,479 B1 | * | 1/2001 | Howell | A44B 11/258 24/DIG. 43 |
| 6,389,653 B1 | * | 5/2002 | Matoba | A44B 11/006 24/615 |
| 6,446,272 B1 | | 9/2002 | Lee | |
| 7,086,126 B2 | | 8/2006 | English | |
| 7,480,967 B2 | * | 1/2009 | Kojoori | G04B 37/1486 2/322 |

(Continued)

FOREIGN PATENT DOCUMENTS

CN 103799621 A 5/2014

OTHER PUBLICATIONS

How To Put On A GRIP6 Belt; Here we show you exactly how to put on a GRIP6 belt. We also show you how it works. Simple, yet so very effective. https://grip6.com; https://www.youtube.com/watch?v=CzuO6dKP3hE&feature=emb_logo; Aug. 25, 2017.

(Continued)

*Primary Examiner* — Richale L Quinn

(74) *Attorney, Agent, or Firm* — Rowand LLP

(57) ABSTRACT

A belt system comprising a belt buckle, a belt strap, and a stopper. The belt buckle has a frame, an attachment assembly defining an inlet and an outlet, and a securing assembly. The belt strap defines a first end and a second end. The stopper is fixedly attached to the second end of the belt strap. The attachment assembly engages the belt strap at the first end though the inlet and engages the stopper at the second end of belt strap to prevent movement of the second end of the belt strap relative to the frame. The securing assembly defines at least one first securing member and at least one second securing member configured to securely engage a first portion and a second portion of the belt strap.

4 Claims, 10 Drawing Sheets

(56) References Cited

U.S. PATENT DOCUMENTS

| | | | | |
|---|---|---|---|---|
| 7,743,473 | B2 * | 6/2010 | Lin | B60P 7/083 24/71 ST |
| 8,065,781 | B2 * | 11/2011 | Chao | A61B 17/1327 254/365 |
| 9,049,894 | B2 * | 6/2015 | Wong | A41F 1/006 |
| 9,173,454 | B2 * | 11/2015 | Liu | A44B 11/006 |
| 9,307,808 | B1 * | 4/2016 | Lill | A44B 99/00 |
| 9,358,415 | B2 * | 6/2016 | Champion | A61H 1/0292 |
| 9,560,898 | B2 * | 2/2017 | Hortnagl | A44B 11/2553 |
| 9,585,445 | B2 * | 3/2017 | Qian | A41F 1/002 |
| 9,730,495 | B2 * | 8/2017 | Howell | A44B 11/25 |
| 9,907,367 | B2 * | 3/2018 | Paik | A41F 1/002 |
| 9,930,936 | B2 * | 4/2018 | Liu | A41F 9/002 |
| 10,617,179 | B2 * | 4/2020 | Fiedler | A44B 11/12 |
| 10,945,476 | B2 * | 3/2021 | Huang | A44B 11/2588 |
| 11,122,869 | B2 * | 9/2021 | Gunie | A44C 5/185 |
| 11,129,450 | B1 * | 9/2021 | Mancini | A44B 11/258 |
| 11,160,330 | B1 * | 11/2021 | Tseng | A44B 11/258 |
| 11,375,778 | B1 * | 7/2022 | Zinnbauer | A44B 11/2596 |
| 11,589,655 | B2 * | 2/2023 | Paik | A44B 11/258 |
| 2004/0107547 | A1 * | 6/2004 | Chung | A44B 11/258 24/303 |
| 2005/0132545 | A1 * | 6/2005 | Anscher | A44B 11/26 24/615 |
| 2006/0168783 | A1 * | 8/2006 | Anscher | A44B 11/266 24/615 |
| 2011/0179604 | A1 * | 7/2011 | Desser | A44C 5/2076 24/303 |
| 2012/0044031 | A1 * | 2/2012 | Ninomiya | A44C 5/2085 335/219 |
| 2014/0277103 | A1 * | 9/2014 | Esposito | A61B 17/1327 24/303 |
| 2018/0360147 | A1 * | 12/2018 | Fiedler | A45C 13/1069 |
| 2022/0061469 | A1 * | 3/2022 | Tseng | A44B 11/28 |
| 2023/0134450 | A1 * | 5/2023 | Barnhart | H04R 1/028 24/303 |

OTHER PUBLICATIONS

Jasgood; No Show Women Stretch Belt Invisible Elastic Web Strap Belt with Flat Buckle for Jeans Pants Dresses; https://www.amazon.com/Stretch-Invisible-Elastic-Buckle-Dresses/dp/B07GWPPSR4 Dec. 10, 2020.

Richter, David; Snap buckle flat 30; https://www.fidlock.com/sites/default/files/08010_SNAP_buckle_flat_30_datasheet.pdf; Dec. 5, 2020.

* cited by examiner

BELT BUCKLE SYSTEMS AND METHODS

TECHNICAL FIELD

The present invention relates to belt systems and methods for inserting belt straps in belt buckles.

BACKGROUND

Belts typically come in various shapes and sizes and are traditionally used to support pants, shorts, etc. when worn around a user's waist. Most belts include a belt buckle and a belt strap that is wrapped around a user's waist and securely engaged with the belt buckle. Holes in the belt strap allow a user to adjust the size of a belt to discrete sizes. One common problem with numerous belts is that the belt cannot easily be adjusted past the predetermined sizes. Meaning a person who loses or gains weight must have a number of belts in different sizes. Another problem is that belt buckles frequently are made to be big and bulky. There exists a need for a belt that can easily adjust to different sizes with a belt buckle that can fit discreetly under the user's clothing.

The present invention relates to belt systems and methods for inserting belt straps in belt buckles.

SUMMARY

The present invention may be embodied as a belt system comprising a belt buckle, a belt strap, and a stopper. The belt buckle has a frame, an attachment assembly defining an inlet and an outlet, and a securing assembly. The belt strap defines a first end and a second end. The stopper is fixedly attached to the second end of the belt strap. The attachment assembly engages the belt strap at the first end though the inlet and engages the stopper at the second end of belt strap to prevent movement of the second end of the belt strap relative to the frame. The securing assembly defines at least one first securing member and at least one second securing member configured to securely engage a first portion and a second portion of the belt strap.

The present invention may also be embodied as a method of forming a belt around a user comprising the following steps. A first end of a belt strap is passed through an inlet in a belt buckle. The belt strap is extended through the inlet until a stopper, fixedly attached to a second end of the belt strap, is in a locked position. The first end of the belt strap is passed through an outlet in the belt buckle. A first portion of the belt strap is engaged with at least one first securing member. The belt strap is looped around at least a portion of the user. The belt strap is secured by pulling the first end of the belt strap with at least one second securing member.

The present invention may also be embodied as a belt system comprising a belt buckle, a belt strap, and a stopper. The belt buckle has a frame having a first plate and a second plate, an attachment assembly, and a securing assembly. The first plate and the second plate are configured to engage each other in a locking position. The attachment assembly defines an inlet and an outlet. The belt strap defines a first end and a second end. The stopper is fixedly attached to the second end of the belt strap. The attachment assembly engages the belt strap at the first end though the inlet and engages the stopper at the stopper at the second end of belt strap to prevent movement of the belt strap. The securing assembly defines at least one first securing member and at least one second securing member configured to securely engage a first portion and a second portion of the belt strap, respectively.

DETAILED DESCRIPTION

As recited herein, the orientation or positional relationship indicated by the orientation words such as "front, back, up, down, left, right", "transverse, vertical, perpendicular, horizontal" and "top, bottom", etc. are usually based on orientation or positional relationship shown in the figures, and are merely for the convenience of the description of the present disclosure and simplifying the description, and unless stated to the contrary. The orientation words are not to indicate or imply that the device or element referred must have a specific orientation or be constructed and operated in a specific orientation, and thus are not to be explained as limiting the scope of the present disclosure. Additionally, the orientation words "first", "second" and the like are used to limit the components and parts only for the purpose of facilitating the distinction between the corresponding components and parts, and unless otherwise stated, the above words have no special meaning and therefore cannot be interpreted as limiting the scope of protection of the present disclosure.

Figure 1:
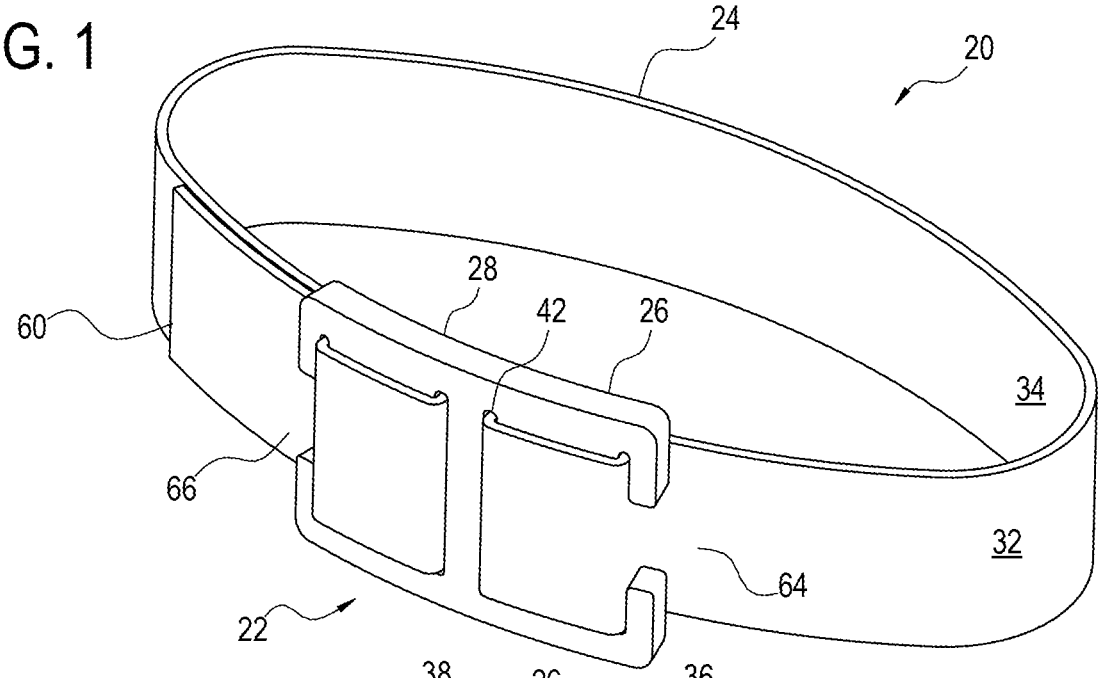
FIG. 1 is a perspective view illustrating the components of a first example belt system of the present invention that is adapted to insert a belt strap into a belt buckle.
Figure 2:
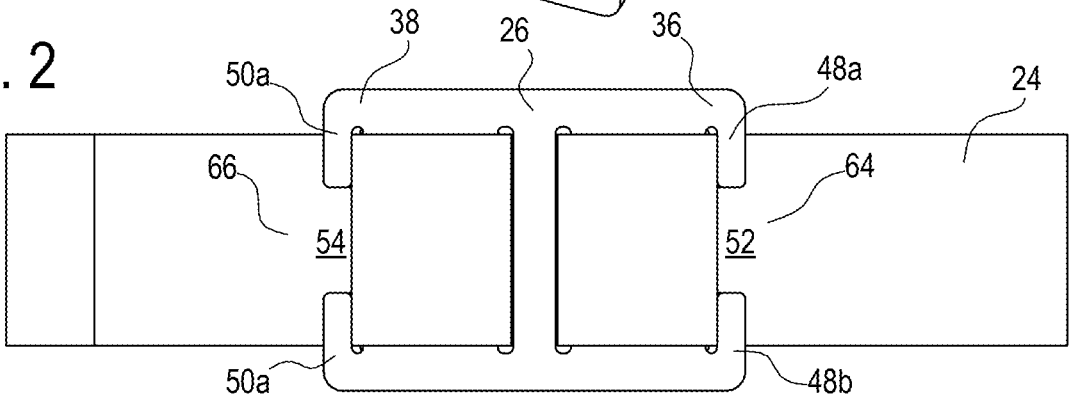
FIG. 2 is a front elevation view of the first example belt system of FIG. 1.
Figure 3:
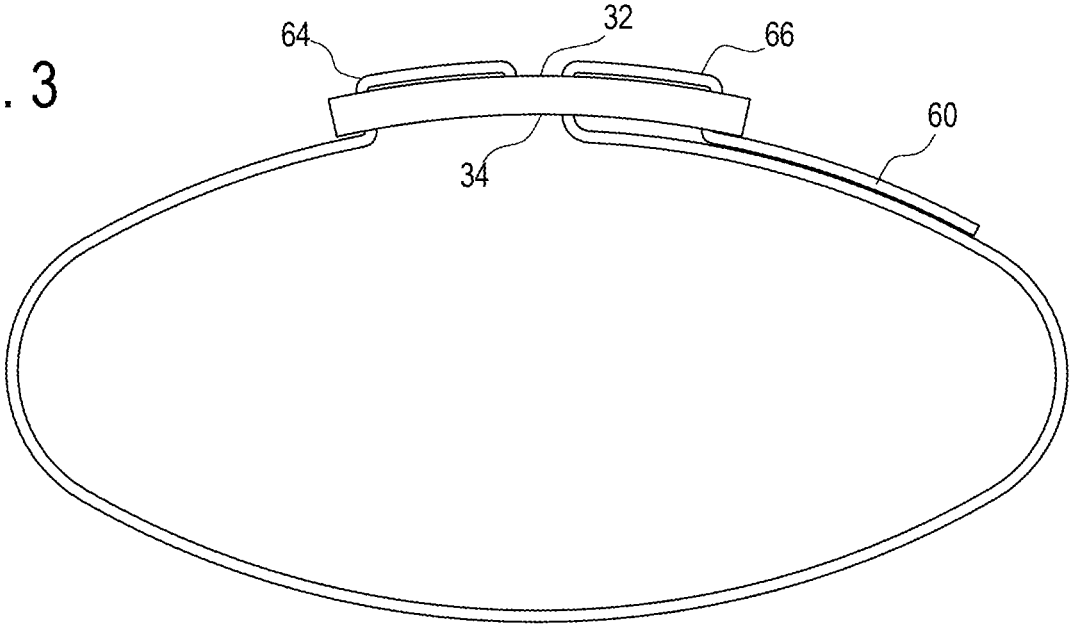
FIG. 3 is a top plan view of the first example belt system of FIG. 1.

Referring initially to FIG. 1 of the drawings, depicted herein is a first example belt system 20 constructed in accordance with, and embodying the principle of the present invention. FIGS. 1-3 illustrates that the example belt system 20 comprises a belt buckle 22 and a belt strap 24. FIG. 1-3 further illustrates that the belt system 20 may be used to insert a belt strap 24 into a belt buckle 22.

Figure 4A:
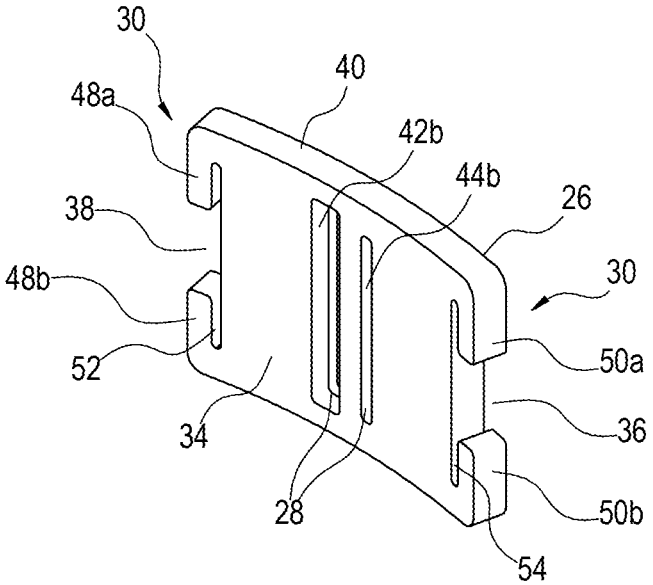
FIG. 4A illustrates the example belt buckle of the first example belt system of FIG. 1.
Figure 4B:
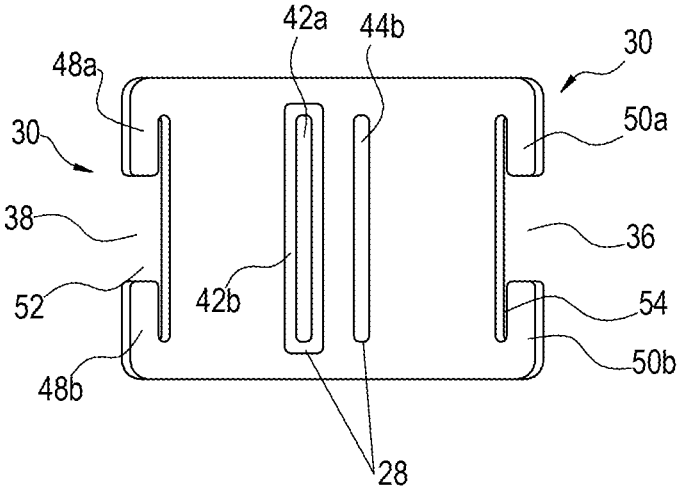
FIG. 4B is a rear elevation view of the belt buckle of FIG. 4A.

As show in FIGS. 4A and 4B, the belt buckle 22 comprises a belt buckle frame 26, a belt strap attachment 28, and a belt strap securing assembly 30. The belt buckle frame 26 defines a front side 32, a back side 34, a first end 36 and a second end 38.

The belt buckle frame 26 may comprise a single curved plate 40. The front side 32 of the belt buckle frame 26 defines a convex side of the plate 40 and the back side 34 of the belt buckle frame assembly 26 defines a concave side of the plate. The degree of curvature of the plate may be chosen to sufficiently fit or approximate the curvature of a user's waist (not pictured).

The belt buckle frame 26 may be constructed of any suitable material. For example, the belt buckle frame assembly 26 can be made of aluminum, steel, carbon fiber, plastic, wood, composite of these materials, and the like. In one example, the curved plate 40 is made of anodized aluminum. The thickness of the curved plate 40 can be any thickness suitable for providing stability to the belt buckle frame assembly 26 and a comforting, low profile, fit for the user.

Figure 5:
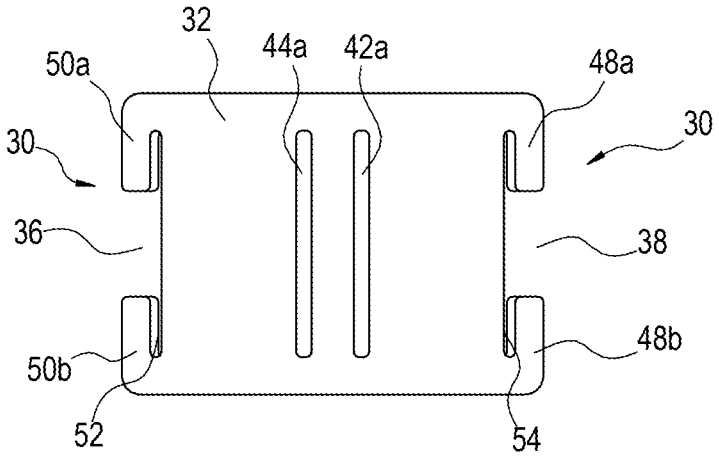
FIG. 5 is a front elevation view of the belt buckle of FIG. 4A.
Figure 6A:
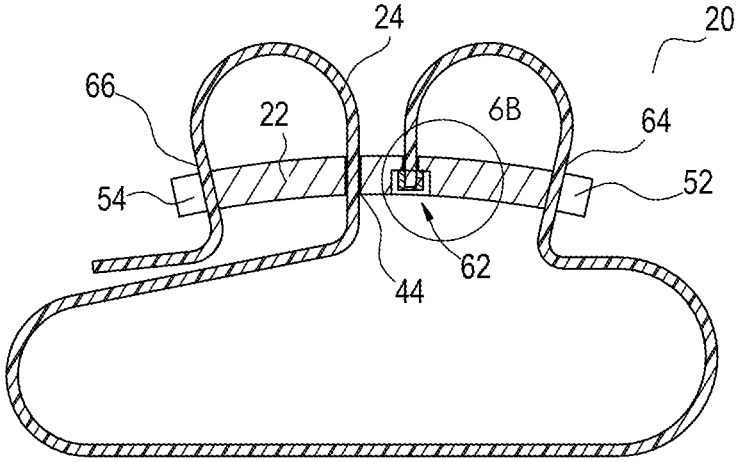
FIG. 6A is a cross sectional view along lines 6-6 in FIG. 10.
Figure 6B:
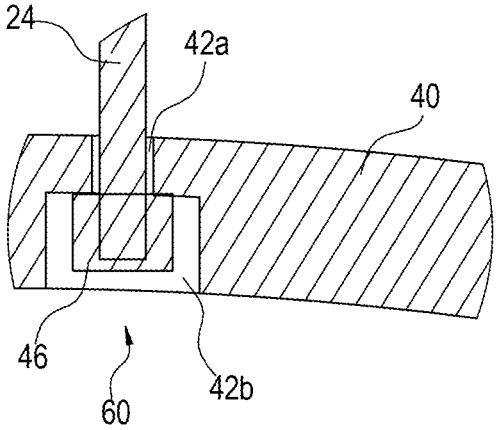
FIG. 6B is a detail of FIG. 6A.

As shown in FIGS. 4-5, the belt strap attachment assembly 30 comprises at least two rectangular slots in the belt buckle frame 26 that extend from the front side 32 of the belt buckle frame 26 to the back side 34 of the belt buckle frame 26. The two slots define a belt strap inlet 42 and a belt strap outlet 44. The belt strap inlet 42 and the belt strap outlet 44 extend from the front side 32 of the belt buckle frame 26 to the back side 34 of the belt buckle frame 26. As shown in FIG. 6 and described in further detail below, the belt strap inlet 42 receives a stopper 46 on the belt strap 24 and the belt strap outlet 44 is configured to receive a corresponding portion of the belt strap 24. The belt strap 24 passes through the belt strap inlet 42 and the belt strap outlets 44, but the stopper 46 does not pass completely through the belt strap inlet 42 as described in further detail below.

The belt strap inlet 42 and outlet 44 may be placed in any orientation relative to one another. For example, the belt strap inlet 42 and outlet 44 are parallel to one another. The belt strap inlet 42 and outlet 44 may also define a front side 42*a*, 44*a* and a back side 42*b*, 44*b* that corresponds with the front side 32 and the back side 34 of the belt buckle frame 26. The front side of the belt strap inlet 42*a* and the front side of the belt strap outlet 44*a* may be any width and height suitable to receive the belt strap. In one aspect, the front sides of the belt strap inlet and outlet 42*a* and 44*a* may be of similar widths and height. The back side of the belt strap inlet 42*b* and the back side of the belt strap outlet 44*b* may be any width and height suitable to receive the belt strap. In one aspect, the back sides of the belt strap inlet and outlet 42*b* and 44*b* may be of different widths and heights. For example, the back side of the belt strap inlet 42*b* is wider and taller than the back side of the belt strap outlet 44*b*. As illustrated in FIG. 6, the example back side of the belt strap inlet 42*b* is sized and dimensioned to receive a stopper 46 on the belt strap 24 such that: (a) the stopper 46 does not extend out of the back side of the belt strap inlet 42*b* beyond the back side 34 of the belt buckle frame 26. Further, the example front side of the belt strap inlet 42*a* is sized and dimensioned to inhibit or prevent passage of the stopper 46 through the front side of the belt strap inlet 42*a*.

Referring again to FIG. 2, the example belt strap securing assembly 30 comprises first securing members 48*a* and 48*b* and second securing members 50*a* and 50*b*. The first securing members 48*a* and 48*b* extend vertically from opposite sides of the first end 36 of the belt buckle frame 26 toward one another.

The belt strap 24 further defines a first end 60 and a second end 62. The first securing members 48*a* and 48*b* define a first belt strap opening 52 configured to secure a first portion 64 of the belt strap 24. The first belt strap opening 52 can be any width suitable for receiving a first portion 64 the belt strap 24. The width and thickness the example first belt strap opening 52 are slightly larger than the corresponding width and thickness of the belt strap 24 such that the belt strap 24 may be moved through the first belt strap opening 52. As illustrated in FIG. 2, the example belt strap 24 is about as wide as or typically slightly narrower than the example first belt strap opening 52 such that the belt strap 24 may be moved through the second belt strap opening 54. To secure the first portion 64 of the belt strap 24 in the first belt strap opening 52, the belt strap 24 is pinched or otherwise deformed to pass side edges of the strap between the corresponding first securing members 48*a* and 48*b*, at which the belt strap 24 returns to its undeformed position within the first belt strap opening 52.

The second securing members 50*a* and 50*b* extend vertically from opposite sides of the second end 38 of the belt buckle frame 26 toward one another. The second securing members 50*a* and 50*b* define a second belt strap opening 54 configured to secure a second portion 66 of the belt strap 24. The second belt strap opening 54 can be any width suitable for engaging the belt strap 24. The width and thickness of the example second belt strap opening 54 are slightly larger than the width and thickness of the belt strap 24 such that the belt strap 24 may be moved through the second belt strap opening 54. As further illustrated in FIG. 6, the belt strap 24 is about as wide as or typically slightly narrower than the second belt strap opening 54 such that the belt strap 24 may be moved through the second belt strap opening 54. In order to secure a second portion of the belt strap 66, the belt strap 24 must be engaged between the second securing members 50*a* and 50*b* to arrange the belt strap 24 securely into the second belt strap opening 54. To secure the second portion 66 of the belt strap 24 in the second belt strap opening 54, the belt strap 24 is pinched or otherwise deformed to pass side edges of the belt strap 24 between the corresponding first securing members 48*a* and 48*b*, at which the belt strap 24 returns to its undeformed position within the second belt strap opening 54.

When the belt strap 24 is wrapped around a user's body (i.e., a user's waist), the stopper 46 is within arranged within the back side of the belt strap inlet 42*b*, the first portion 64 is secured within the first belt strap opening 52, and the second portion 66 is secured within the second belt strap opening 54 to secure the belt system 20 around the user.

Figure 7:
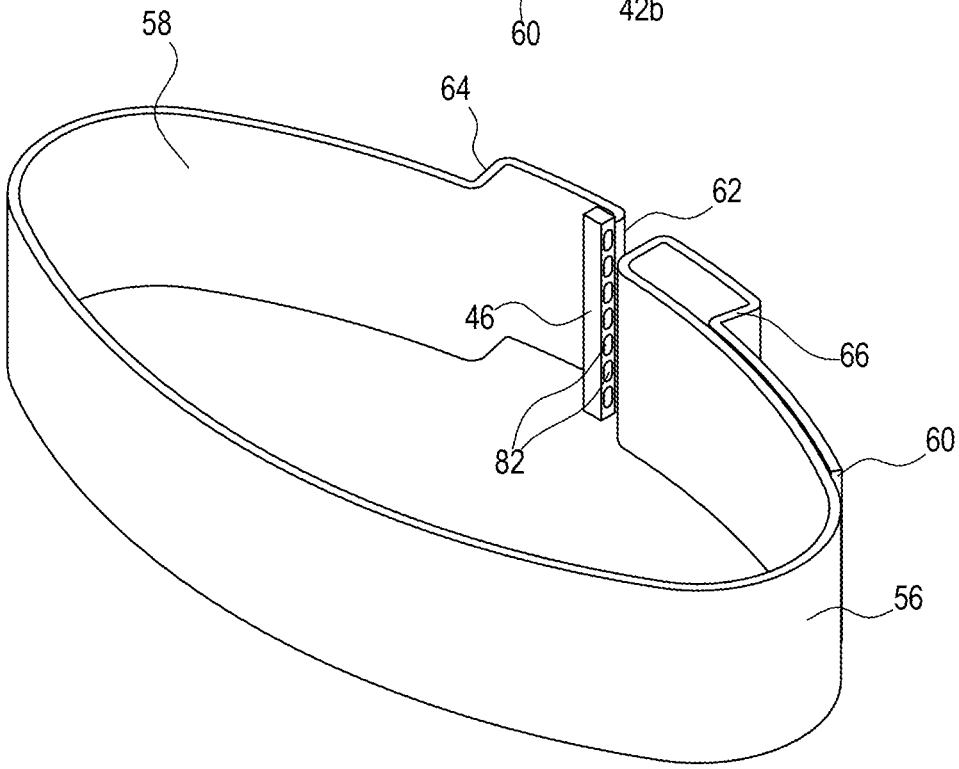
FIG. 7 illustrates the example belt strap of the first example belt system of FIG. 1.

As illustrated in FIG. 7, the belt strap 24 defines a front side 56 and a back side 58. The belt strap 24 may be made of any suitable type and may be constructed of any suitable material, such as nylon, polyester, cotton, leather, canvas, or another suitable material or any combination or a composite of two or more materials. The belt strap 24 is wrapped around the user's waist, usually through belt loops on pants (not pictured), and may be of any suitable length in order to securedly engage the belt buckle. In one aspect, the belt strap 24 is made of a stretchable material so that the belt strap can provide a secure fit for any user. When the belt system 20 is engaged, the back side 58 of the belt strap 24 is closest to the user.

The belt strap 24 has a width and a thickness designed to securely engage with the belt buckle and provide a relatively tight fit for the user. For example, the width and the thickness of the belt strap 24 can be configured to facilitate easy movement of the belt strap 24 through the inlet 42 and outlet 44 of the belt buckle 22, while preventing slippage of the first and second portions of the belt strap 64, 66 within the first and second opening 52, 54. Other considerations such as comfort, style, sizing, etc. are also used to determine the width and the thickness of the belt strap.

The first end 60 may be sealed or fixed in a way that prevents the belt strap 24 from coming apart, unraveling or fraying. The belt strap 24 may be sealed using any suitable technique. For example, the first end 60 of the belt strap 24 may be heat sealed. The first end 60 of the belt strap 24 can have any width suitable to allow passage through the belt strap inlet and outlet.

Referring again to FIG. 7, the second end 62 of the belt strap 24 comprises the stopper 46 configured to prevent the belt strap 24 from disengaging from the belt buckle 22 when subjected to tension from the user. The stopper 46 may be made from plastic and have a width and height corresponding to the height and width of the back side of the belt buckle inlet 42*b*. The purpose being to allow easy passage of the belt strap 24 through the belt strap inlet 42 and to securely engage the stopper 46 within the back side of the belt buckle inlet 42*b* to prevent the belt strap 24 from being pulled entirely through the belt buckle inlet 42.

Figure 8A:
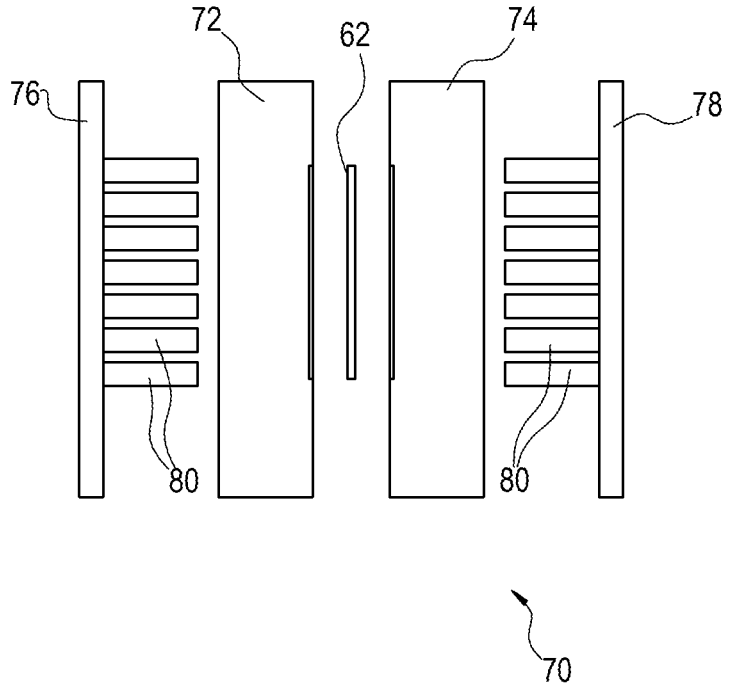
FIG. 8A-8D illustrates the process of injection molding the example stopper to the end of the belt strap.
Figure 8B:
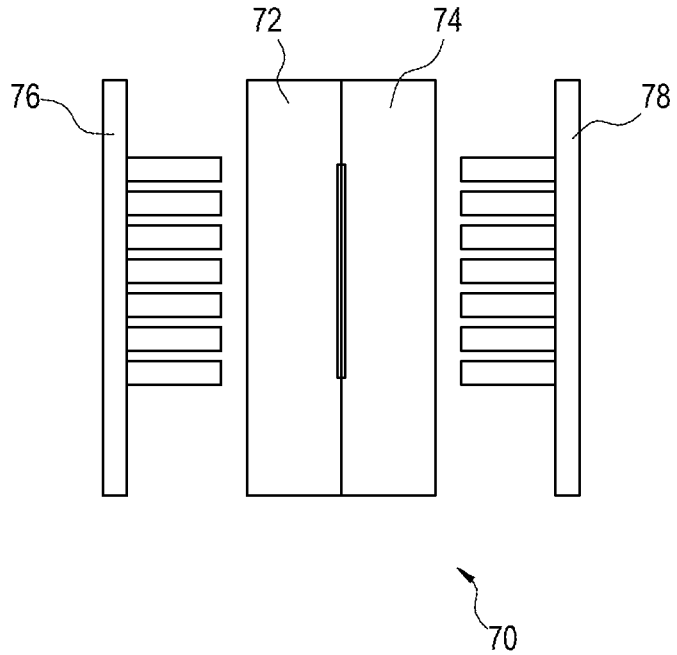
Figure 8C:
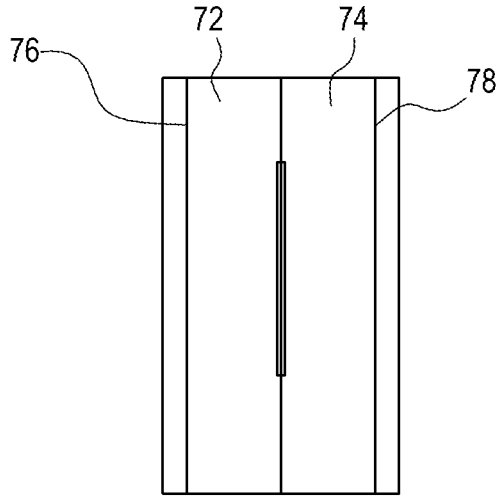
Figure 8D:
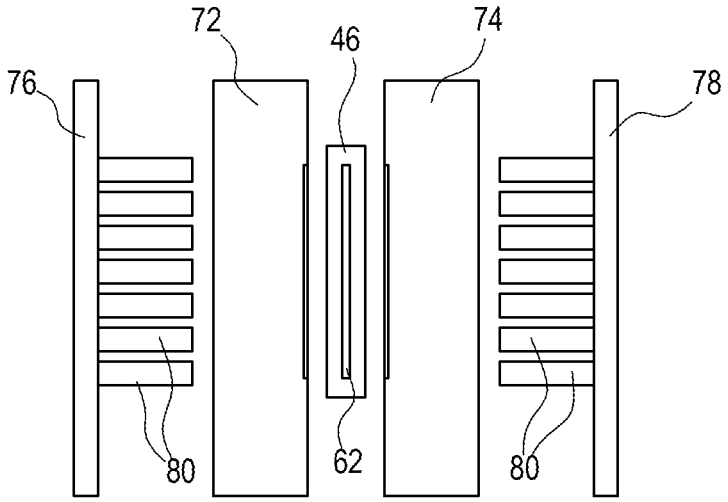

As shown in FIGS. 8A and 8B, the stopper 46 is securely attached to one end of the belt strap 24. In particular, the stopper 46 is injection molded in a clamshell mold assembly 70 around the second end 62 of the belt strap 24. The mold assembly comprises first and second clamshell portions 72 and 74 and first and second pin portions 76 and 78. Movable pins 80 supported by the mold pin portions 76 and 78 to hold the end of the belt strap 24 in place during the injection step. Once the plastic has solidified, the pin portions 76 and 78 are displaced away from each other to retract the pins 80 and the clamshell portions 72 and 74 are displaced away from each other to allow the stopper 46 and second end 62 of the belt strap 24 to be removed from the mold, leaving holes 82 (FIG. 7) perpendicular to the part line formed by the two clamshell portions 72 and 74 of the mold assembly 70, as shown in the FIGS. 8C and 8D. The injected hot plastic will flow into or conform to the textured surface of the belt strap 24 and may even slightly melt the ends of the belt strap 24 to enhance the bond between stopper 46 and the second end 62 of the belt strap 24.

Figure 9:
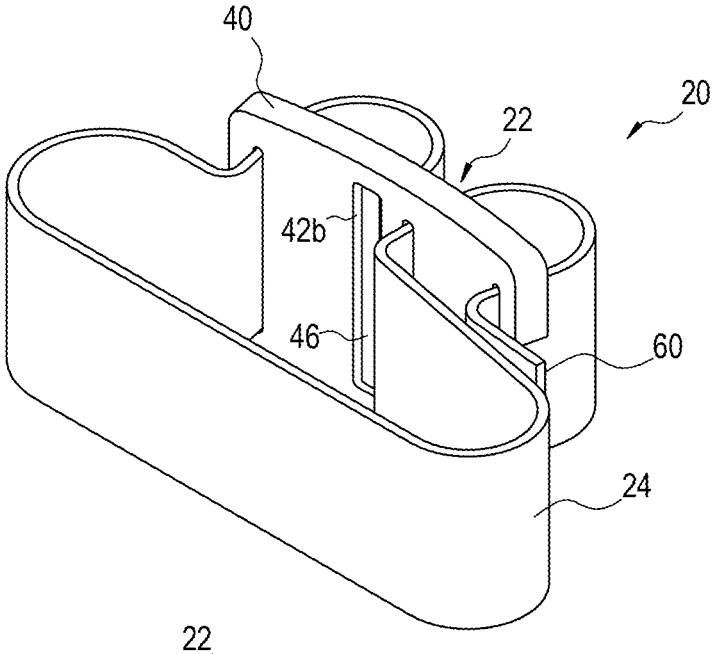
FIG. 9 is a rear elevation view of the first example belt system of FIG. 1.
Figure 10:
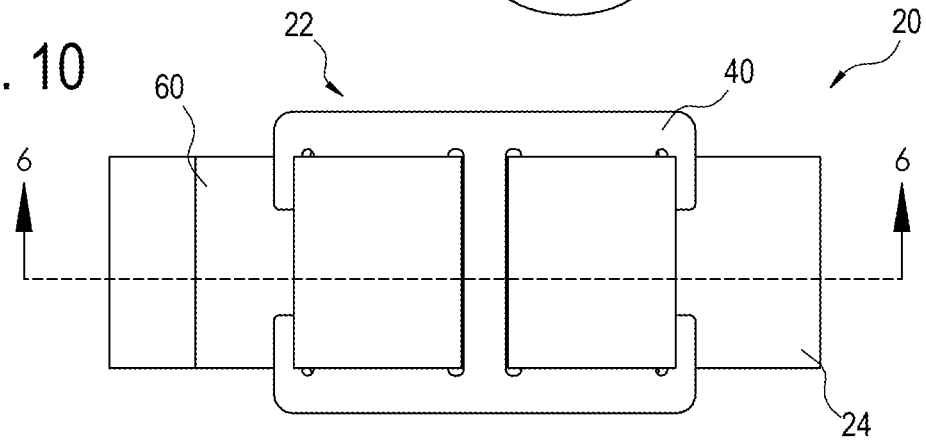
FIG. 10 is a front elevation view of the first example belt system of FIG. 1.
Figure 11:
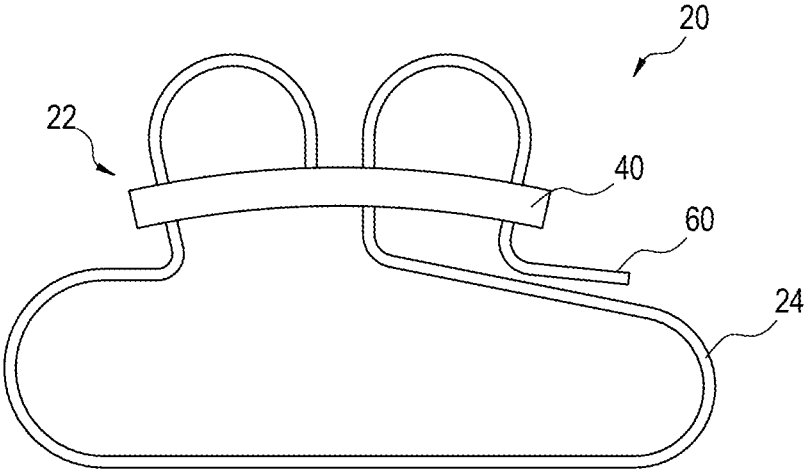
FIG. 11 is a top plan view of the belt strap being pulled through the belt buckle in the first example belt system of FIG. 1.

FIGS. 9-11 illustrate a method of securely engaging the belt strap in the belt buckle. The first end 60 of the belt strap 24 is passed through the inlet and pulled until the stopper 46 engages with a surface portion of the buckle 22 defining the back side of the belt strap inlet 42*b* as shown in FIG. 6. So engaged, the stopper 46 will be in a locked position and the second end of the belt strap will be fixed within the belt buckle frame 26, preventing further movement of the second end 62 relative to the buckle 22. The first end 60 of the belt strap 24 is looped around the belt buckle frame 26 towards the first securing projections 48*a* and 48*b*. The first end 60 of the belt strap 24 is pulled through the first belt strap opening 52. The belt strap 24 is pulled tightly to securely engage a first portion of the belt strap 64 within the first belt strap opening 52 to increase the tension between the belt strap and the first securing projections and prevent slippage of the first portion of the belt strap 64 within the first belt strap opening 52.

The first end 60 of the belt strap 24 is moved around the user's body, such that the back side 58 of the belt strap 24 is maintained in a position proximate the user's waist. A tension force is applied to the belt strap 24 to secure a relatively tight fit around the user's waist. The belt strap 24 can be pulled with as much force as necessary to provide a comfortable fit and prevent slippage during use. Once a proper fit has been established, the first end 60 of the belt strap 24 is inserted into belt strap outlet 44 from the back side 44*b* and exit the belt buckle 22 through the front side of the belt strap 44*a*.

The belt strap 24 is finally secured by looping the first end 60 of the belt strap 24 towards the second securing projections 50*a* and 50*b*. The second portion 66 of the belt strap 24 is engaged in the second belt strap opening 54. The belt strap 24 is pulled tightly within the second belt strap 54 to increase the tension between the belt strap 24 and the second securing projections 50*a* and 50*b* and prevent slippage of the second portion 66 of the belt strap 24 within the second belt strap opening 54.

Figure 12:
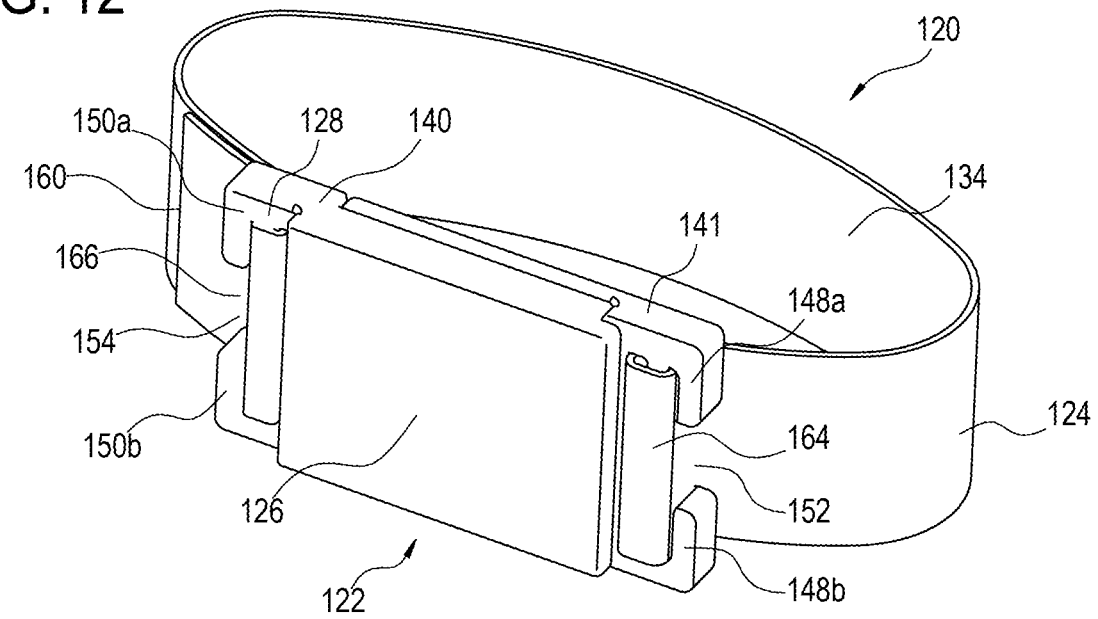
FIG. 12 is a perspective view illustrating components of a second example belt system.
Figure 13:
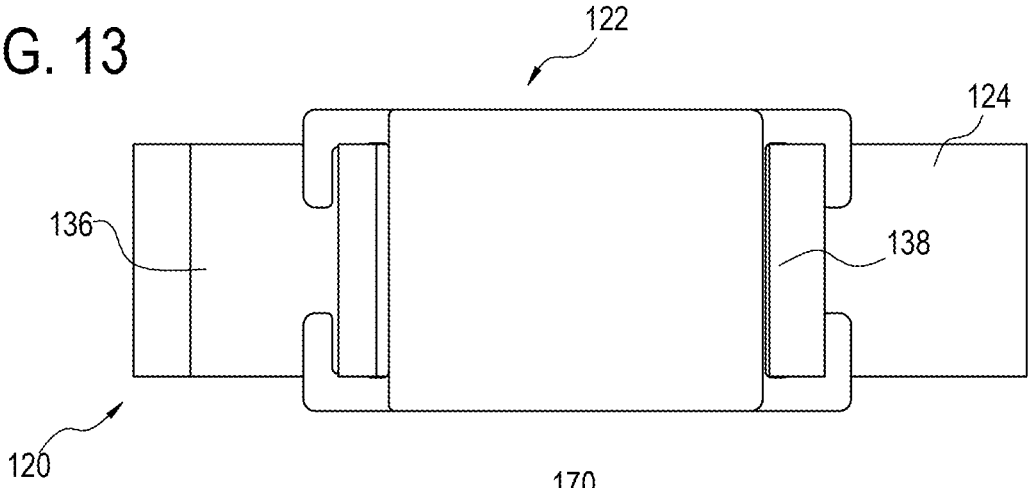
FIG. 13 is a front elevation view of the second example belt system of FIG. 12.
Figure 14:
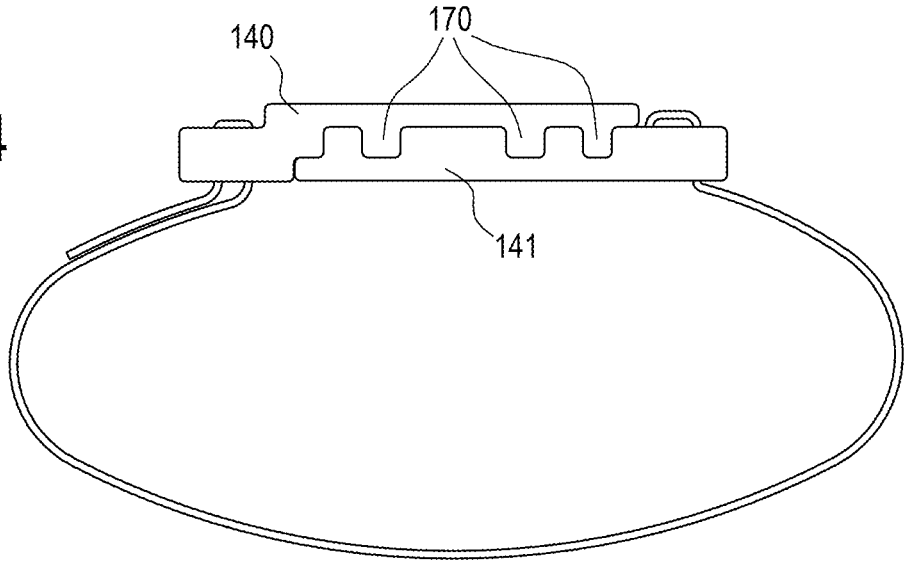
FIG. 14 is a top plan view of the second example belt system of FIG. 12.

Referring now to FIGS. 12-14 of the drawings, depicted therein is a second example belt system 120 constructed in accordance with, and embodying, the principles of the present invention. FIG. 12 illustrates that the second example belt system 120 comprises a belt buckle 122 and a belt strap 124. FIG. 13 further illustrates that the belt system 120 may be used to insert a belt strap 124 into a belt buckle 122. The belt buckle 122 comprises a belt buckle frame assembly 126, a belt strap attachment assembly 128, and a belt strap securing assembly 130. The belt buckle frame assembly defines a first end 136 and a second end 138. The belt buckle frame assembly 126 comprises a front plate 140 and a back plate 141. The front plate and back plates may be flat or curved. In one aspect, the front plate 140 and the back plate 141 are both substantially flat.

The belt buckle frame assembly 126 may be constructed of any suitable material. For example, the belt buckle frame assembly 126 can be made of aluminum, steel, carbon fiber, plastic, wood, composite of these materials, and the like. In one example, the front plate 140 and the back plate 141 are made of injection molded plastic. The thickness of the front and back plates 140 and 141 can be any thickness suitable for providing stability to the belt buckle frame assembly 126 and a comforting, low profile, fit for the user. Other considerations such as style, sizing, etc. are also used to determine the width and the thickness of the front and back plates of the frame assembly.

Figure 18:
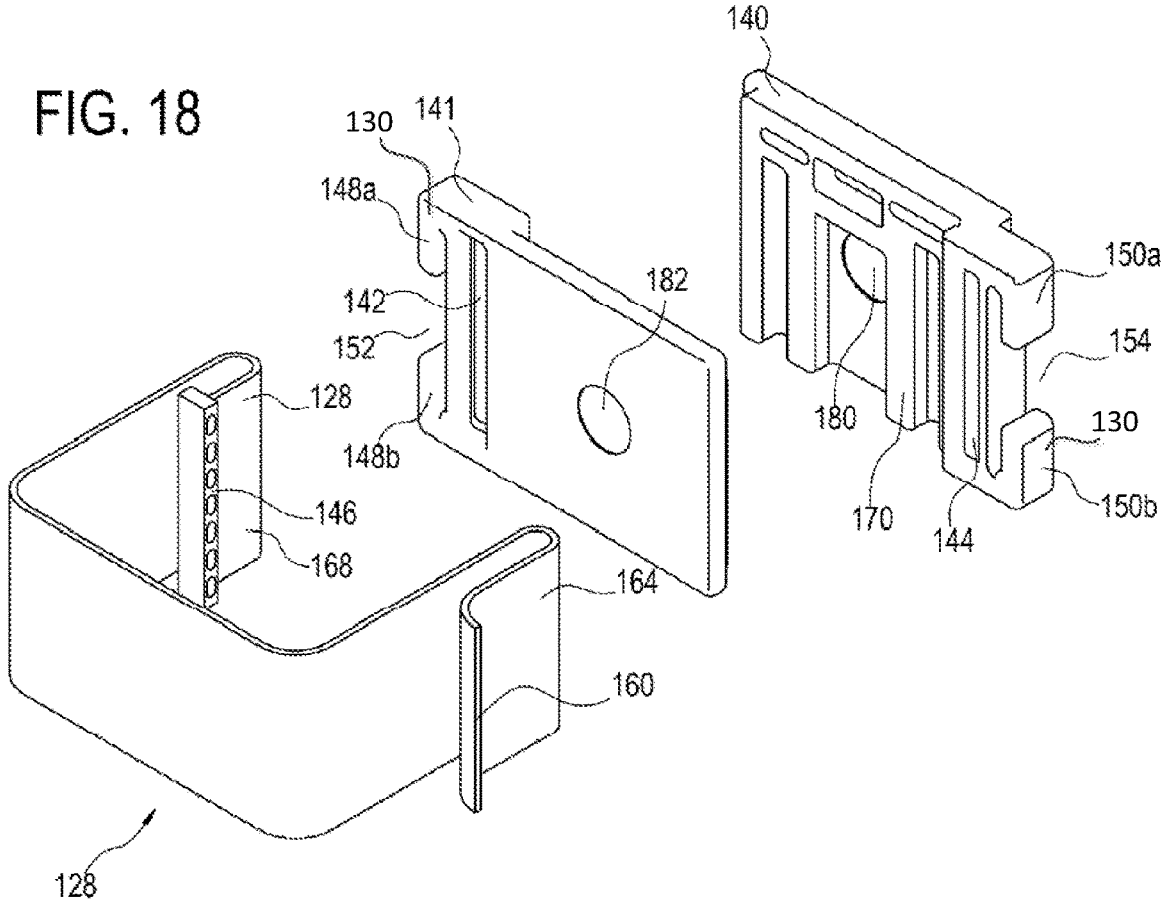
FIG. 18 is an exploded view of the second example belt system of FIG. 12.
Figure 19:
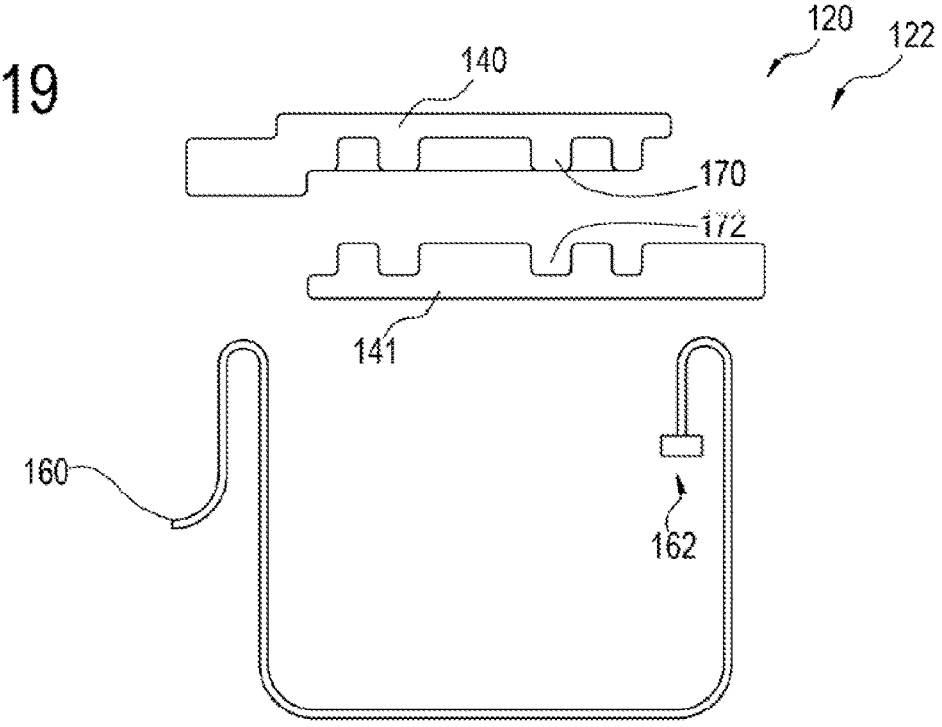
FIG. 19 is a top exploded view of the second example belt system of FIG. 12.

Referring now to FIGS. 18 and 19, the front plate 140 and the back plate 141 of the belt buckle frame assembly are configured to engage each other in a locking position. The front plate 140 has a plurality of "male" locking projections 170 on an inside of the front plate 140. The back plate 141 has a plurality of "female" locking projection receivers 172 on an inside of the back plate 141. The plurality of "male" locking projections 170 of the front plate 140 and the plurality of "female" locking projection receivers 172 of the back plate 141 may further comprise first and second magnetic members 180 and 182. The magnetic members may comprise magnets having opposite polarity or a magnetic and a magnetically attractable material. When the belt buckle frame assembly is engaged in a closed or locking position, the plurality of "male" locking projections 170 and the plurality of "female" locking projections receivers 172 will align and the magnetic portions 180 and 182 in the locking projections will be attached to each other, causing the front plate 140 and the back plate 141 to be securely engaged with one another. When the belt buckle frame assembly is in an open position, the front plate 140 and the back plate 141 will be moved away from each other, breaking the magnetic attraction between the plurality of "male" locking projections 170 and the plurality of "female" locking projection receivers 172.

Figure 15:
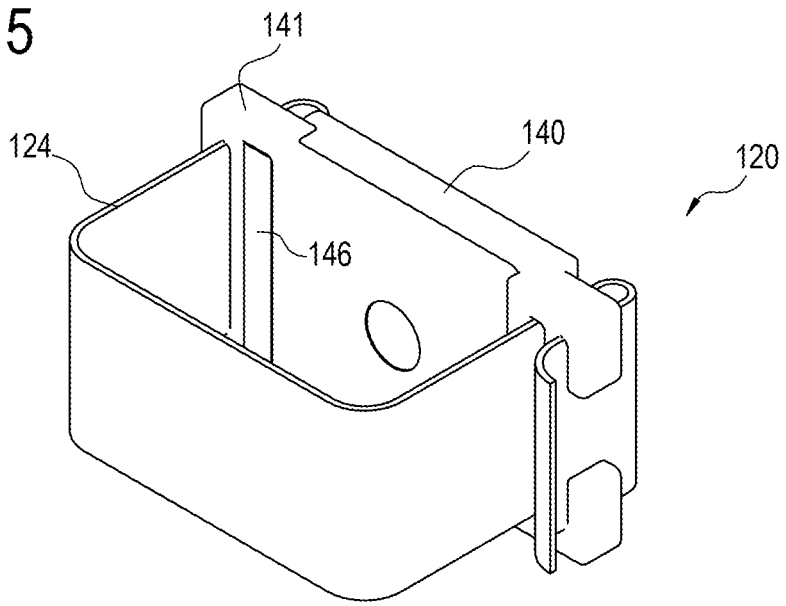
FIG. 15 is a rear elevation view of the second example belt system of FIG. 12.
Figure 21:
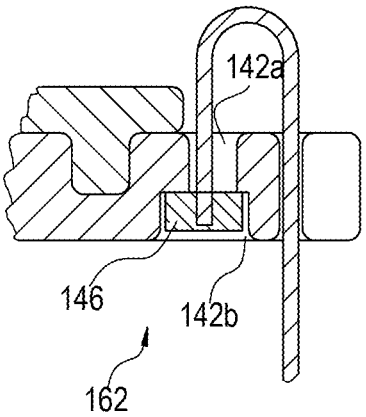
FIG. 21 is a detail cross sectional view taken of section 21 in FIG. 20.

As shown in FIG. 15, the belt strap attachment assembly comprises at least two rectangular slots in the belt buckle frame assembly that extending the front plate 140 and the back plate 141 of the belt buckle frame assembly. The two slots define a belt strap inlet 142 and a belt strap outlet 144. The belt strap inlet 142 receives a stopper 146 on the belt strap 124, and the belt strap outlet 144 is configured to receive a corresponding portion of the belt strap 124. The belt strap 124 passes through the belt strap inlet 142 and the belt strap outlet 144, but the stopper 146 does not pass completely through the belt strap inlet 142 as shown in FIG. 21 and as described in further detail below. The stopper 146 may be secured to the belt strap 124 as described in FIGS. 8A-8D above.

When the front plate 140 and the back plate 141 are in the closed position, the belt strap inlet 142 extends from a front side of the front plate 140 to a back side of the back plate 141. Similarly, the belt strap outlet 144 extends from the front side of the front plate 140 to the back side of the back plate 141. The belt strap inlet 142 and the belt strap outlet 142 are configured to receive a corresponding portion of the belt strap 124, as described in more detail below. The belt strap 124 passes through the belt strap inlet 142 and the belt strap outlet 144.

The belt strap inlet 142 and outlet 144 may be substantially parallel to one another. The belt strap inlet 142 and outlet 144 may also define a front side and a back side that corresponds with the front side and the back side of the belt buckle frame assembly 126. The front side of the belt strap inlet 142*a* and the front side of the belt strap outlet 144*a* may be any width and height suitable to receive the belt strap 124. In one aspect, the front sides 142*a* and 144*a* of the belt strap inlet and outlet may be of similar widths and height. The back side of the belt strap inlet 142*b* and the back side of the belt strap outlet 144*b* may be any width and height suitable to receive the belt strap. In one aspect, the back side of the belt strap inlet 142*b* is wider and higher than the back side of the belt strap outlet 144*b*. The back side of the belt strap inlet 142*b* is sized to receive the securing projection at the second end of the belt strap.

Figure 16:
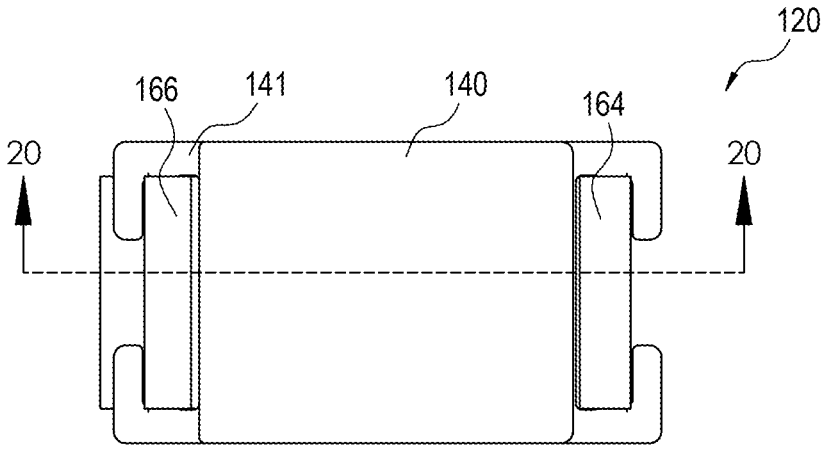
FIG. 16 is a front plan view of the second example belt system of FIG. 12.
Figure 17:
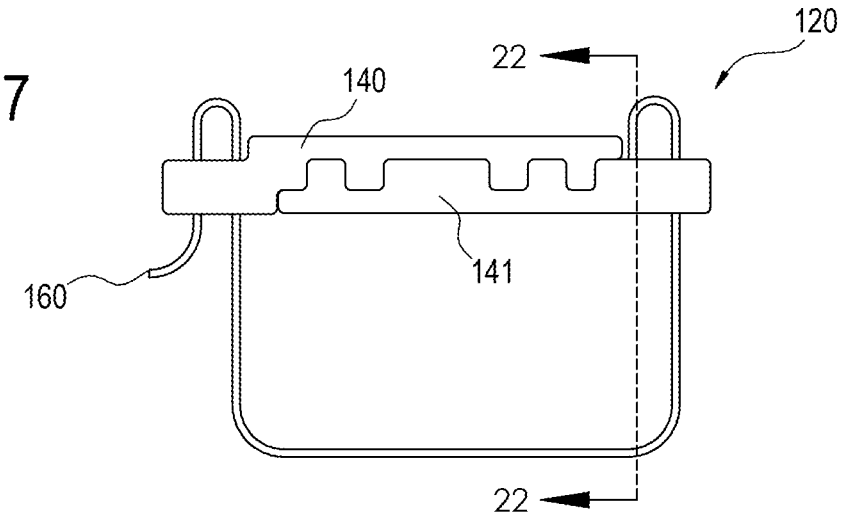
FIG. 17 is a top plan view of the second example belt system of FIG. 12.

As shown in FIGS. 15-17, the belt strap securing assembly 130 comprises first securing members 148*a* and 148*b* and second securing members 150*a* and 150*b*. The first securing members 148*a* and 148*b* extend vertically from opposite sides of the first end of the frame 136 toward one another. The first securing members 148*a* and 148*b* define a first belt strap opening 152 configured to secure a first portion of the belt strap 164. The first belt strap opening 152 can be any width suitable for engaging the belt strap 124. The width of the first belt strap opening 152 must correspond to the width and thickness of the belt strap. In order to secure the first portion of the belt strap 164, the belt strap 124 must be engaged through the first securing members 148*a* and 148*b* to secure the belt strap in the first belt strap opening 152. Once secured, the belt strap 124 is wrapped around a user's waist.

The second securing members 150*a* and 150*b* extend vertically from opposite sides of the second end 138 of the belt buckle frame assembly 126 toward one another. The second securing members 150*a* and 150*b* define a second belt strap opening 154 configured to secure a second portion of the belt strap 166. The second belt strap opening 154 can be any width suitable for engaging the belt strap. The width of the second belt strap opening 154 must correspond to the width and thickness of the belt strap. In order to secure a second portion of the belt strap 166, the belt strap 124 must be engaged between the second securing members 150*a* and 150*b* to arrange the belt strap 124 securely into the second belt strap opening 154. The second portion of the belt strap 166 is displaced away from the second belt strap opening 154 to provide a secure fit for the user and to minimize relative movement between the belt strap 124 and the belt buckle 122.

Figure 20:
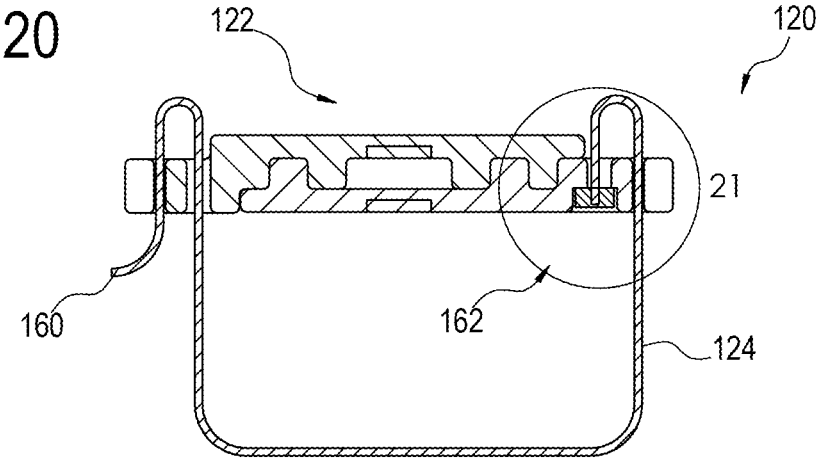
FIG. 20 is a cross sectional view taken along lines 20-20 in FIG. 16.
Figure 22:
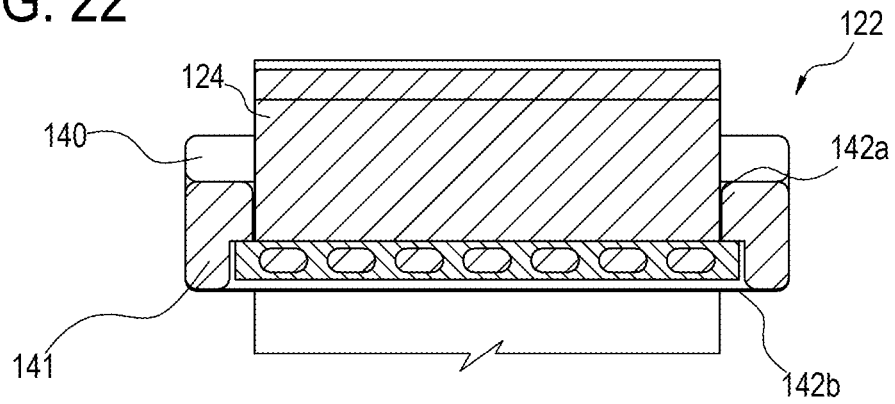
FIG. 22 is a side cross sectional view taken along lines 22-22 in FIG. 17.

As shown in FIGS. 20-22, the belt strap 124 of the second example belt system 120 comprises a belt strap 124 that is made in a manner similar to that of the belt strap 24 of the first example belt system 20 described above. As discussed above, the belt strap 124 defines a front side 156, a back side 158, a first end 160 and a second end 162. Additionally, belt strap 124 comprises a stopper 146 securely attached to the second end 162 of the belt strap 124. The stopper 146 of the belt strap 124 of the second example belt system 120 is securely attached in a manner similar to that of the stopper 46 of first example belt system 20.

Referring again to FIGS. 15-17, a method of securely engaging the belt strap 124 in the belt buckle 122 is illustrated for the second example belt system 120. As show in FIGS. 18 and 19, in the open position, the front plate 140 and the back plate 141 are disengaged and separated from one another. The first end 160 of the belt strap 124 is passed through the belt strap inlet 142 from the back side 142*b* to front side 142*a* of the belt strap inlet. The belt strap 124 pulled until the stopper engages with the back side 142*b* of the belt strap inlet 142. So engaged, the second end 162 of the belt strap 124 will be fixed in the belt buckle frame assembly 126, preventing further movement.

The first end 160 of the belt strap 124 is looped around the belt buckle frame assembly 126 towards the first securing projections 148*a* and 148*b*. The first portion of the belt strap 164 is engaged in the first belt strap opening 152. The belt strap is pulled tightly within the first belt strap opening to increase the tension between the belt strap and the first securing projections and prevent slippage of the first portion of the belt strap 164 within the first belt strap opening 152.

The first end 160 of the belt strap 124 is moved around the user's body, such that the back side 158 of the belt strap 124 is maintained in a position proximate the user's waist. The belt strap 124 is pulled to secure a relatively tight fit around the user's waist. The belt strap 124 can be pulled with as much force as necessary to provide a comfortable fit and prevent slippage during use. Once a proper fit has been established, the first end 160 of the belt strap 124 is inserted into the belt strap outlet 154 from the back side 154*b* and exit the belt buckle frame assembly 126 through the front side 144*b* of the outlet 144.

The belt strap 124 is finally secured by looping the second end 162 of the belt strap 124 towards the second securing projections 150*a* and 150*b*. The second portion of the belt strap 166 is engaged in the second belt strap opening 154. The belt strap 124 is pulled tightly within the second belt strap opening 154 to increase the tension between the belt strap and the second securing projections 150*a* and 150*b* and prevent slippage of the second portion of the belt strap 166 within the second belt strap opening 154.

Once the fit of the belt strap 124 is sufficiently established and the belt strap is secured in the belt buckle frame assembly 126, the first plate 140 and the second plate 141 are moved to their closed or locking positions. When the belt buckle frame assembly is engaged in a closed or locking position, the "male" locking projections 170 and the "female" locking projections receivers 172 will align and the magnets in the locking projections will attract one another causing the front plate 140 and the back plate 141 to be securely engaged with one another. The belt buckle frame assembly will be locked in this position until the user disengages the first plate 140 from the second plate 141.

What is claimed is:

1. A belt system comprising:

a belt buckle having, a frame having a first plate and a second plate, wherein the first plate and the second plate are configured to engage each other in a locking position, an attachment assembly defining an inlet extending between a front side and a back side of the second plate and an outlet extending between a front side and a back side of the first plate, and a securing assembly, a belt strap defining a first end and a second end; and a stopper fixedly attached to the second end of the belt strap;

wherein the attachment assembly is configured to receive the first end of the belt strap through the inlet and wherein the inlet is dimensioned to receive the stopper therein for engaging against the back side of the first plate to prevent passage of the stopper through the inlet, and wherein the securing assembly defines at least one first securing member and at least one second securing member configured to securely engage a first portion and a second portion of the belt strap, respectively.

2. The belt system of claim 1, wherein the first plate includes a plurality of locking projections and the second plate includes a plurality of locking projection receivers.

3. The belt system of claim 2, wherein the plurality of locking projections and the plurality of projection locking receivers comprise at least first and second magnetic members, where the at least first and second magnetic members are magnetically attracted to each other.

4. The belt system of claim 3, wherein when the first plate and the second plate are engaged in the locking position, the plurality of locking projections and the plurality of locking projection receivers are configured to align and the magnetic members are configured to attract.

* * * * *